US005127623A

United States Patent [19]

McDugle

[11] Patent Number: 5,127,623

[45] Date of Patent: Jul. 7, 1992

[54] INNER SEAL FOR RAM-TYPE BLOWOUT PREVENTER

[75] Inventor: Garry L. McDugle, Houston, Tex.

[73] Assignee: Petro-Flex Rubber Products, Inc.

[21] Appl. No.: 772,557

[22] Filed: Oct. 7, 1991

[51] Int. Cl.[5] ..... E21B 33/06

[52] U.S. Cl. ..... 251/1.3; 277/129

[58] Field of Search ..... 251/1.3; 277/129, 180

[56] References Cited

U.S. PATENT DOCUMENTS 1,695,992 12/1928 Bergsten .
3,272,222 9/1966 Allen .
3,434,729 3/1969 Shaffer et al. .
4,089,532 6/1978 Kamyshnikov et al. .
4,265,424 5/1981 Jones ..... 251/1.3
4,398,729 8/1983 Bishop et al. .
4,541,639 9/1985 Williams III ..... 251/1.3 X
4,703,938 11/1987 Fox .

*Primary Examiner*—John C. Fox
*Attorney, Agent, or Firm*—Dodge, Bush, Moseley & Riddle

[57] ABSTRACT

An inner seal assembly for a pair of opposed ram bodies (12, 14) of a ram-type blowout preventer (10) includes an elastomeric packer (22) and a resilient insert (23). Resilient insert (23) has a plurality of lugs (58) which fit within indentations (36) in a recess (34) formed by the packer (22) and guide insert (23) into an accurate position within the packer (22) for securement to the packer (22) by separate fasteners (56). The insert (23) has an arcuate length of around 190° and extends radially inwardly of the packer (22) in an open position a distance (D1) of at least around 1/16 inch to provide a marginal wear portion.

11 Claims, 4 Drawing Sheets

INNER SEAL FOR RAM-TYPE BLOWOUT PREVENTER

FIELD OF THE INVENTION

This invention relates to an inner seal for a ram-type blowout preventer for oilfield drilling equipment and more particularly to such an inner seal on a packer including a removable insert for sealing tightly against a tubular member.

BACKGROUND OF THE INVENTION

Heretofore, inner seal assemblies have been provided for ram-type blowout preventers on oilfield drilling equipment for sealing the annulus about a tubular member such as a drill pipe. A blowout preventer normally has two opposed ram blocks mounted for inward movement toward each other for sealing engagement with the pipe. Each ram block has a packer formed of an elastomeric or hard rubber material for engaging the outer periphery of the pipe with the packers deforming against the pipe to form a tight seal. Each packer has a semicircular opening or recess to receive the pipe and form a tight seal with 180° of the outer periphery of the pipe. Examples of such blowout preventers are shown in U.S. Pat. Nos. 1,695,992 dated Dec. 18, 1928 and 3,272,222 dated Sep. 13, 1966.

During a stripping operation, the drill pipe is pulled from the well bore with the blowout preventer in sealing relation against the drill pipe and frictional contact between the blowout preventer and the pipe being removed may result in considerable wear against the seal. For that reason, a wear insert may be added to the packer for contacting the pipe. For example, as shown in U.S. Pat. No. 4,398,729 dated Aug. 16, 1983, a semicircular insert is provided formed of a suitable resilient material which may include a nylon and/or urethane material. Such a semicircular insert is received within a recess in the packer and is urged against the elastomeric packer when contacting the drill pipe under substantial fluid pressure from the ram. The insert illustrated in U.S. Pat. No. 4,398,729 includes a pair of integral outwardly extending projections which are received within corresponding grooves for mounting of the insert within the packer. The resilient insert is depressed inwardly when initially inserted within the grooves to provide yieldable cooperation between the insert and the packer.

Screws or nails have also been utilized heretofore for retaining the insert in position within the elastomeric packer. However, upon closing of the ram and rotation of the drill pipe, the screws or nails tend to strip out of the elastomeric packer and if the fasteners are stripped from the elastomeric packer, the insert will spin or rotate with the drill pipe.

SUMMARY OF THE INVENTION

The present invention is directed to an inner seal on a packer including a removable insert for sealing tightly against the pipe. The insert is received within an arcuate semicircular recess in the elastomeric packer. The insert includes a plurality of rearwardly extending projections or lugs which fit within corresponding grooves in the semicircular recess so that the insert is slidable into and out of the recess within any yielding or deformation of the insert being required. The insert is secured within the recess to the elastomeric packer by separate fasteners, such as screws, and the lugs guide and position the insert accurately within the recess for securement by the separate fasteners. The lugs prevent any rotative movement of the insert and eliminate any shearing forces being exerted against the screws such as resulting from rotation of the pipe during a stripping action when the blowout preventer is in a closed position about the pipe, for example.

When the blowout preventer is closed about the pipe the resilient insert is urged outwardly in a generally radial direction against the elastomeric packer until the adjacent sealing faces of the packer are in tight sealing contact with the pipe. Since the insert is pressed radially outwardly into the elastomeric packer during sealing about the pipe, it is desirable to have the insert extend radially inwardly beyond the packer in a rest or opened position of the packer. Further, it is desirable to have the insert extend in an arcuate direction more than 180°. In this manner, a substantial portion of the insert may be worn away and yet an effective seal provided against the pipe in the closed position of the pipe. For example, an insert adapted for use with an elastomeric packer for sealing about a pipe having an outer diameter may project radially inwardly beyond the sealing faces of the associated packer a radial distance of about ⅛ inch and may be an arcuate configuration preferably about 190°.

In addition, the end planar sealing faces of the insert are skewed or inclined around 5° in a radially outwardly direction from the inner peripheral surface of the resilient insert. Thus, upon initial contact of opposed inserts in opposed packers during closing of the blowout preventer the radially outermost surfaces of the end faces first contact and upon deformation of the inserts and elastomeric packers during the sealing action and outward radial movement of the insert against the elastomeric packers, the opposed sealing faces of the inserts move into a substantially flush relation thereby to provide an effective sealing relation about the pipe.

It is an object of this invention to provide a long lasting resilient insert for an elastomeric packer of a ram-type blowout preventer for sealing the annulus about a tubular member.

It is a further object of this invention to provide such an insert which is of an arcuate shape greater than 180° and extends radially inwardly beyond the elastomeric packer in the open position of the blowout preventer thereby to provide a wear portion for the insert.

Other objects, features, and advantages of this invention will be apparent from the following specification and drawings.

DESCRIPTION OF THE INVENTION

Figure 1:
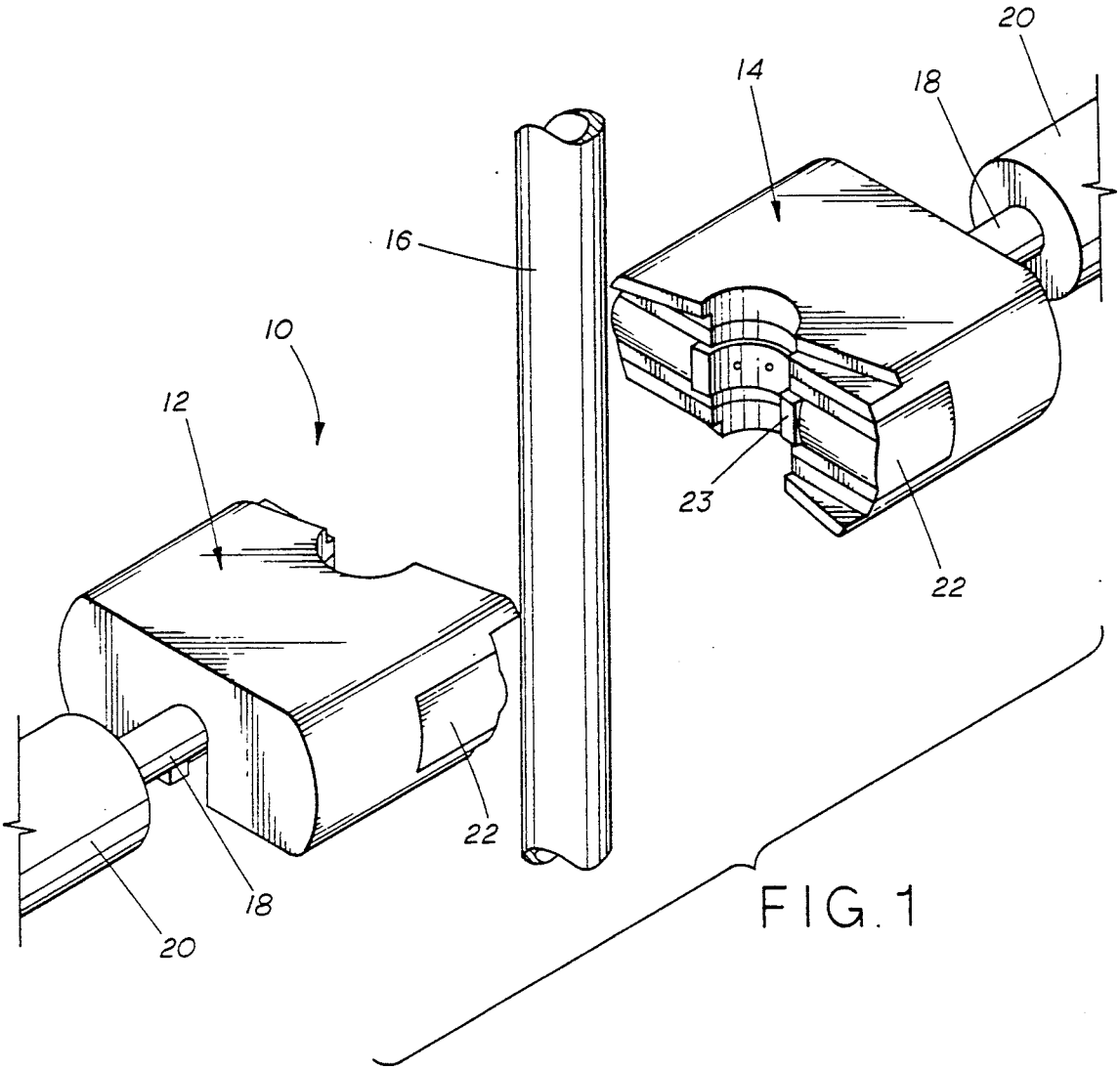
FIG. 1 is a perspective, partly schematic, of a portion of a ram-type blowout preventer showing the ram body and packer for sealing against a pipe and including the insert comprising the present invention.
Figure 2:
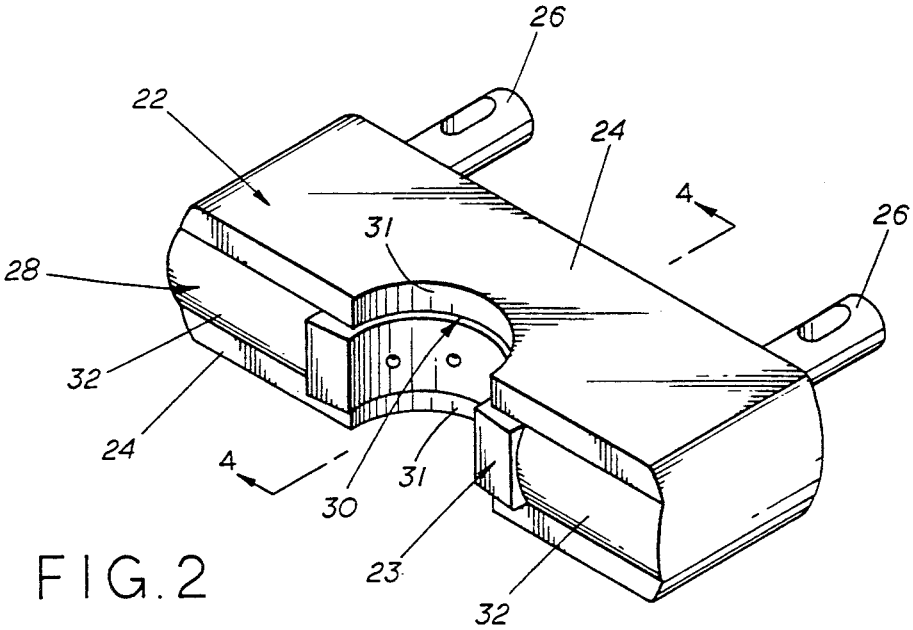
FIG. 2 is a perspective view of the packer and insert removed from the ram body.
Figure 3:
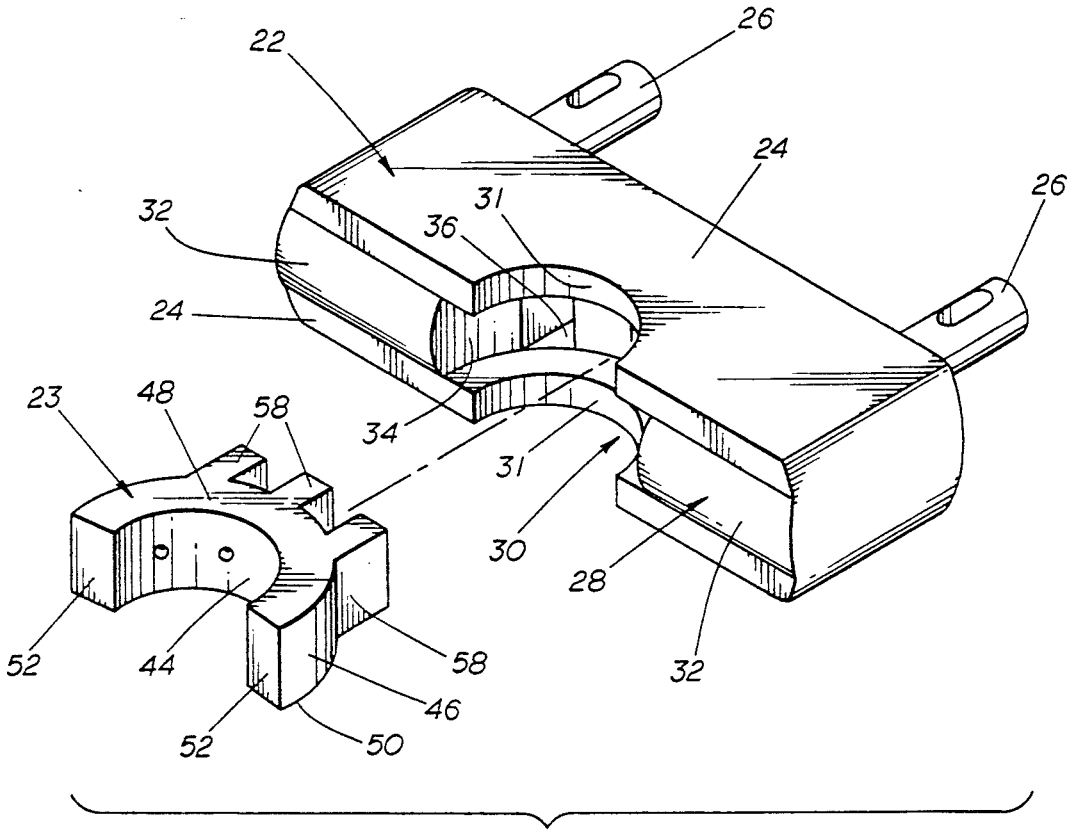
FIG. 3 is an exploded view of the packer and insert of FIG. 2.
Figure 4:
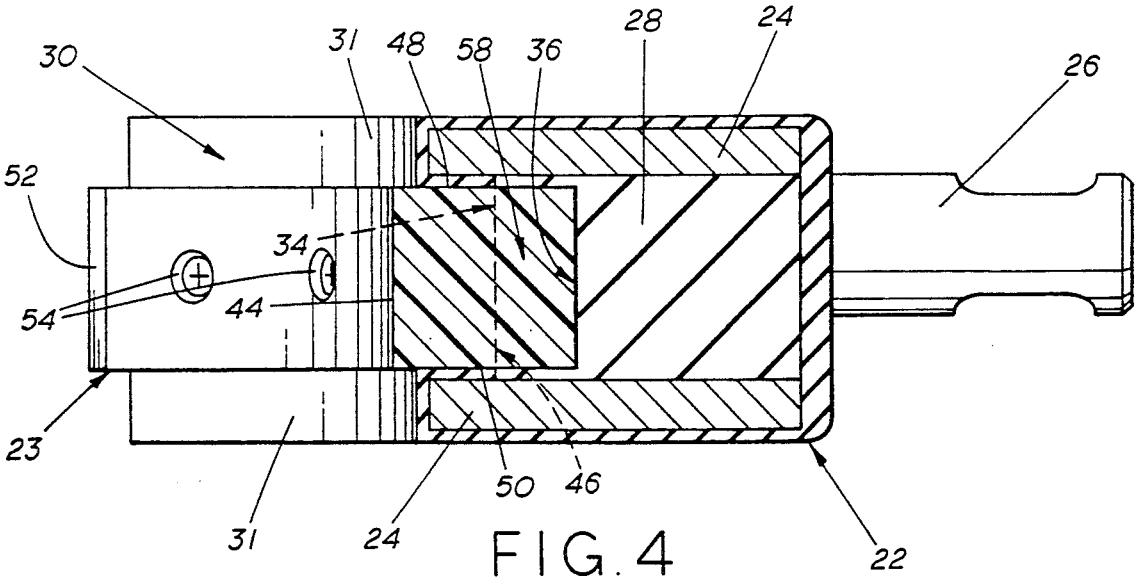
FIG. 4 is a section taken generally along line 4—4 of FIG. 2.

Referring to the drawings for a better understanding of this invention and more particularly to FIG. 1, a portion of ram-type blowout preventer for oilfield drilling equipment is shown generally at 10 with a pair of opposed ram bodies indicated generally at 12 and 14 for fitting about the outer periphery of a pipe 16 from a bore hole (not shown) in sealing relation upon closing of the blowout preventer. Each ram body 12, 14 is connected to a piston rod 18 extending from a fluid cylinder 20 for movement of the associated ram body in a radial direction when closed in sealing relation about pipe 16. Ram body 12 is illustrated in exploded relation.

The inner seal assembly is formed by an elastomeric packer shown generally at 22 and a removable resilient insert carried by packer 22 and indicated generally at 23. Packer 22 is an integrally molded structure including a pair of upper and lower metal plates 24 and a pair of outwardly extending studs 26. A suitable elastomeric member 28 such as rubber is molded or bonded about plates 24 and studs 26 to form packer 22. Studs 26 are removably secured to body 12 along with a top seal (not shown) for securement of packer 22.

A semicircular opening 30 in packer 22 defined by arcuate surfaces 31 on plates 24 is provided in the sealing face of packer 22 and generally planar end sealing faces 32 are provided adjacent semicicular opening 30 for engaging similar opposed end faces on opposed ram body 14. A generally semicircular recess 34 is provided in the elastomeric member 28 between plates 24 and a plurality of indentations or grooves 36 extend radially outwardly of recess 34. Each indentation 36 defines a pair of parallel planar side surface 38 extending in a direction at right angles to the generally planar end sealing faces 32 of packer 22 and connected by a rear planar surface 40.

Resilient insert 23 forms an important part of this invention and is adapted to fit within recess 34 of packer 22. Insert 23 is of an arcuate shape having a rectangular cross section defining inner and outer concentric peripheral surfaces 44, 46 and lower and upper planar surfaces 48, 50. Planar end face seal surfaces 52 are formed on the ends of insert 23. Openings 54 extend through insert 23 and are adapted to receive suitable fasteners, such as wood screws 56 for securing insert 23 to the elastomeric material of packer 22. A plurality of integral lugs or projections 58 extend rearwardly from outer peripheral surface 46 for guiding and positioning insert 23 accurately within recess 34. Each lug 58 has a pair of planar parallel side surface 60 extending in a direction at right angles to the end sealing faces 32 of packer 22 to permit sliding positioning of insert 23 within recess 34 with lugs 58 recessed within indentations 36 without any yielding of insert 23. Likewise insert 23 may be easily removed from recess 34 without any yielding. A planar rear end surface 62 extends between planar side surfaces 60. Intermediate lug 58 extends outwardly to a greater extent than end lugs 58. End surfaces 62 on end lugs 58 are generally in alignment with the outermost extent of outer peripheral surface 46 of insert 23.

Figure 5:
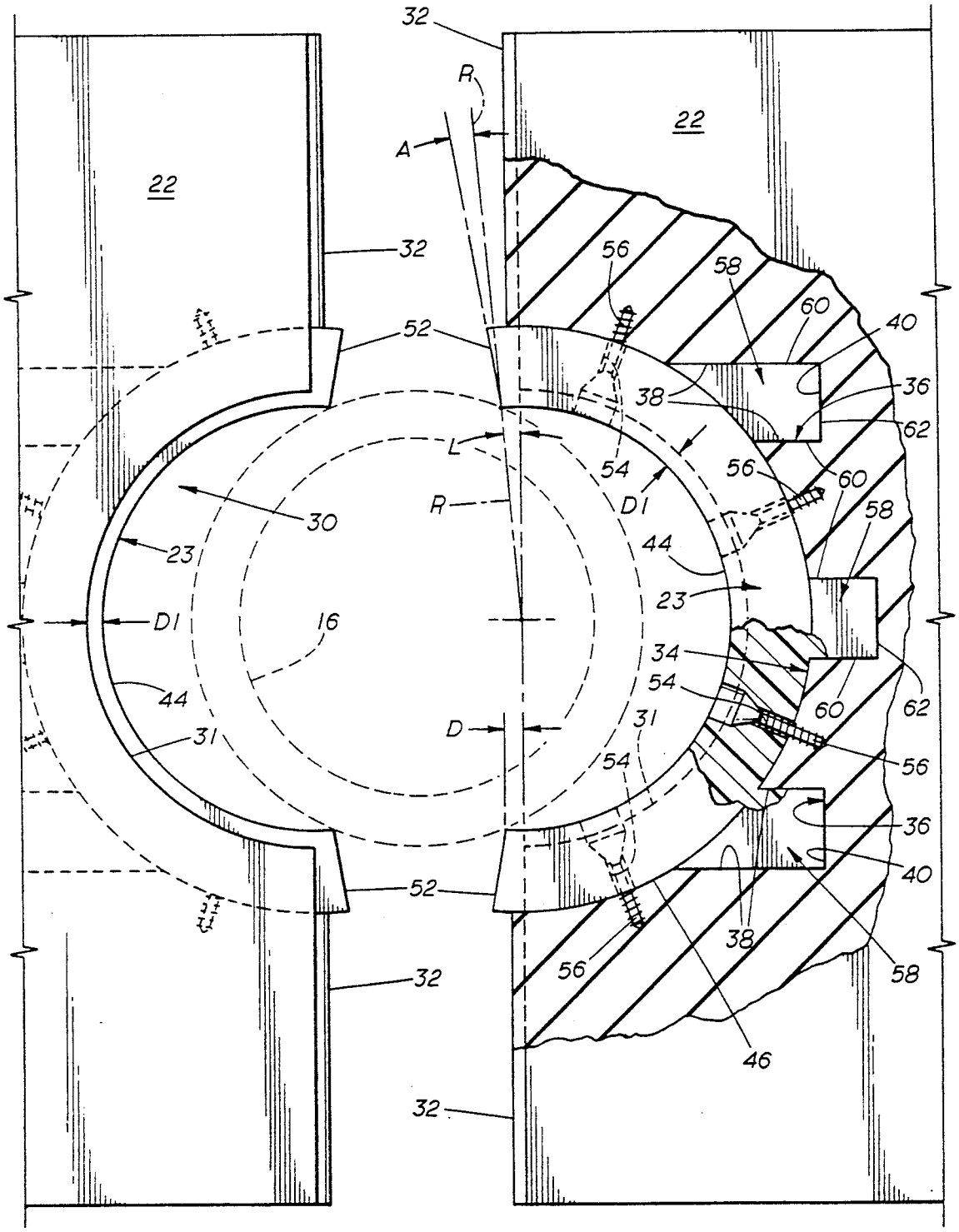
FIG. 5 is a top plan of the opposed packers with inserts therein upon the initial contact of the inserts during closing of the blowout preventer about the pipe and prior to any deformation of the resilient inserts and elastomeric packers.
Figure 6:
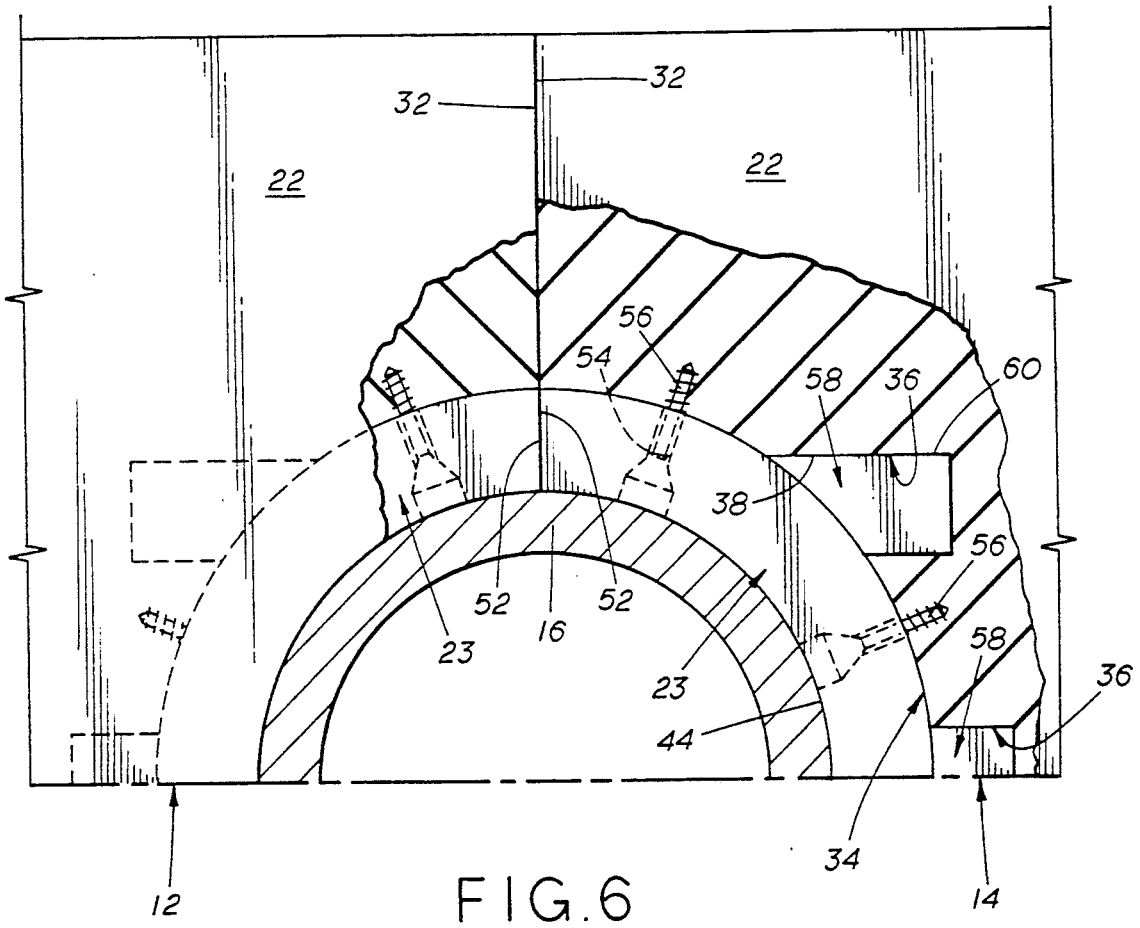
FIG. 6 is a top plan similar to FIG. 5 but showing the inserts and packers in fully closed relation about the pipe.

Since insert 23 is subjected wear particularly during a stripping operation in which the pipe is removed while the blowout preventer is in a closed sealed position about the pipe, it is desirable to provide the insert with a substantial inner marginal portion thereof which may be worn away by frictional contact with pipe and yet provide an effective seal against the pipe when the blowout preventer is in closed position about the pipe. For that purpose, the arcuate length of insert 23 is greater than 180° and preferably around 190° so that end faces 52 of insert 23 project radially outwardly beyond end seal faces 32 of packer 22 in the open inoperable position of the blowout preventer a distance D as shown in FIG. 5 of at least around 1/16 inch and preferably around 3/16 inch for sealing around a pipe having a diameter of 4½ inches. Likewise the inner peripheral surface 44 of insert 23 projects a distance D1 beyond the arcuate surfaces 31 defining semicircular opening 30 on packer 22 of at least 1/16 inch and preferably about 3/16 inch for sealing about a pipe having a diameter of 4½ inches. The arc or arcuate length indicated at L is around 5° beyond the semicircular arcuate length. End face seals 52 of insert 23 are skewed away from a radial direction indicated at R an angle A of preferably around 5° outwardly of inner peripheral surface 44.

As shown in FIG. 5, during movement of the blowout preventer to a closed sealed position about pipe 16 the radially outermost surfaces of opposed end faces 52 on opposed inserts 23 first contact each other with end faces 32 on opposed packers 22 spaced from each other. Inward radial movement of ram bodies 12, 14 results in the deformation of resilient inserts 23 and elastomeric packers 22 with inserts 23 being pressed into the adjacent elastomeric packers 22 unit sealing faces 32 on opposed packers 22 are in flush sealing contact with each other about pipe 16 and end faces 52 on opposed inserts 23 are in flush contact relation in generally the same plane as sealing faces 32 of packers 22.

From the foregoing, it is apparent that substantial wear may occur along the inner peripheral surface 44 of insert 23 while insert 23 maintains its sealing capacity against the outer peripheral surface of pipe 16. Further, any rotation of pipe 16 when packers 22 are in closed position tending to rotate or twist inserts 23 is resisted by lugs 58 fitting within indentations 36. Thus, fasteners 56 are not subjected to any shear forces tending to dislodge the fasteners. Lugs 58 and containing indentations 36 by having planar side surfaces 60 and 38 extending at right angles to planar seal faces 32 guide and position the associated insert 23 accurately within recess 34 without any yielding or bending of insert 23. Insert 23 may be formed of various resilient materials which have desired wear characteristics such as thermoplastic materials. A material which has been found to be satisfactory in ultra high molecular weight polyethylene (UHMWP). Other suitable materials may include nylon, urethane, or nitride-butadiene for example.

While a preferred embodiment of the present invention has been illustrated in detail, it is apparent that modifications and adaptations of the preferred embodiments will occure to those skilled in the art. However, it is to be expressly understood that such modifications and adaptations are within the spirit and scope of the present invention as set forth in the following claims.

What is claimed is:

1. An inner seal assembly for a ram body of a ram-type blowout preventer comprising:

a packer having an inner generally planar sealing face with a semicircular opening therein and a semicircular recess adjacent said opening defining at least one indentation therein extending in a direction generally perpendicular to said generally planar sealing face at least in the closed position of the seal assembly about the pipe; and a resilient insert fitting within the semicircular recess of said packer, said insert comprising an arcuate portion of an arc greater than 180° and less than around 200° and defining inner and outer concentric peripheral surfaces;

said insert having at least one lug extending outwardly from said outer peripheral surface and having generally parallel planar sides surfaces, said lug received within the indentation of said packer and resisting rotative movement of said insert relative to said packer.

2. An inner seal assembly as set forth in claim 1 wherein separate fasteners extend through said insert and into said elastomeric packer for securing said insert therein.

3. An inner seal assembly as set forth in claim 2 wherein said indentation is defined by a pair of parallel planar side surfaces and a planar rear surface extending between and connecting said parallel side surface, and said lug is secured within said indentation with said parallel side surfaces of said lug in close fitting opposed relation to said planar side surfaces of said indentation for guiding and positioning said insert within said recess whereby said insert is slidable into position within said recess without any deformation of said insert.

4. An inner seal assembly as set forth in claim 3 wherein said inner peripheral surface of said insert is positioned radially inward of said semicircular opening in said packer a distance of at least around 1/16 inch.

5. An inner seal assembly as set forth in claim 4 wherein said arcuate portion has an arc of around 190° and said insert has planar end seal faces extending radially outwardly from the inner peripheral surface of said insert.

6. An inner seal assembly as set forth in claim 1 wherein said insert has three lug extending outwardly from said outer peripheral surface to define a pair of end lugs and an intermediate lug therebetween, said intermediate lug extending from the apex of said insert and said end lugs being spaced equally from said intermediate lug and extending in parallel relation thereto.

7. An inner seal assembly for a ram body of a ram-type blowout preventer comprising:

a packer having an inner generally planar sealing face with a semicircular opening therein and a semicircular recess adjacent said opening defining a plurality of indentations therein extending in parallel relation in a direction generally perpendicular to said generally planar sealing face at least in the closed position of the seal assembly about the pipe;

a resilient insert fitting within the semicircular recess of said packer, said insert comprising an arcuate portion of an arc greater than 180° and less than around 200° and defining inner and outer concentric peripheral surfaces;

said insert having a plurality of lugs extending in a parallel relation outwardly from said outer peripheral surface and having generally parallel planar side surfaces, said lugs received within the indentations of said packer and resisting rotative movement of said insert relative to said packer; and separate fasteners extending through said insert into said elastomeric packer for securing said insert therein.

8. An inner seal assembly as set forth in claim 7 wherein said inner peripheral surface of said insert is positioned radially inward of said semicircular opening in said packer a distance of at least around 1/16 inch.

9. An inner seal assembly as set forth in claim 8 wherein said arcuate portion has an arc of around 190° and said insert has planar end seal faces extending radially outwardly from the inner peripheral surface of said insert.

10. A method for assembling an inner seal assembly of a ram-type blowout preventer and for closing the inner seat assembly in sealing relation about a pipe in a bore hole comprising the steps of:

providing an elastomeric packer having a planar end sealing faces and a semicircular opening therein with a semicircular recess extending radially outwardly of said semicircular opening and having an indentation therein defining parallel planar surfaces;

providing an arcuate resilient insert having a radially projecting lug thereon defining a pair of parallel side surfaces;

sliding said insert within said recess with said indentation receiving said projecting lug abnd said parallel side surfaces of said lug being in close fitting opposed relation to said parallel planar surfaces of said indentation, and with the inner peripheral surface of said insert projecting radially inwardly a distance of at least around 1/16 inch into the semicircular opening of said elastomeric packer; and closing said packer and insert carried thereby against the pipe in said bore hole with said insert being forced outwardly toward said elastomeric packer with said packer and insert deforming against the outer periphery of said pipe to form a tight seal thereat.

11. A method for an inner seal assembly as set forth in claim 10 further including the steps of:

forming said resilient insert of an arc greater than around 185° and providing planar end sealing faces in the ends of said insert; and closing said packer and insert carried thereby against said pipe with the radially outermost portions of said end sealing faces first contacting opposed complementary end sealing faces on an opposed insert for deforming said end sealing faces whereby said end sealing faces on the inserts are in flush relation after closing of the packer.

* * * * *